US011414997B2

(12) United States Patent
Eshak et al.

(10) Patent No.: US 11,414,997 B2
(45) Date of Patent: Aug. 16, 2022

(54) ADAPTIVE MACHINING OF COOLED TURBINE AIRFOIL

(71) Applicant: Siemens Energy Global GmbH & Co. KG, Munich (DE)

(72) Inventors: Daniel M. Eshak, Orlando, FL (US); Susanne Kamenzky, Berlin (DE); Samuel R. Miller, Jr., Port St. Lucie, FL (US); Daniel Vöhringer, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 282 days.

(21) Appl. No.: 16/478,004

(22) PCT Filed: Jan. 12, 2018

(86) PCT No.: PCT/US2018/013435
§ 371 (c)(1),
(2) Date: Jul. 15, 2019

(87) PCT Pub. No.: WO2018/132629
PCT Pub. Date: Jul. 19, 2018

(65) Prior Publication Data

US 2019/0368357 A1 Dec. 5, 2019

Related U.S. Application Data

(60) Provisional application No. 62/445,956, filed on Jan. 13, 2017.

(51) Int. Cl.
*F01D 5/18* (2006.01)
*F01D 5/14* (2006.01)

(52) U.S. Cl.
CPC ..... *F01D 5/18* (2013.01); *F01D 5/147* (2013.01); *F05D 2230/14* (2013.01);
(Continued)

(58) Field of Classification Search
CPC ..... F01D 5/18; F01D 5/147; F05D 2230/14; F05D 2230/18; F05D 2230/21; F05D 2240/304
See application file for complete search history.

(56) References Cited

U.S. PATENT DOCUMENTS 8,506,256 B1 8/2013 Brostmeyer et al.
2012/0179285 A1 7/2012 Melzer-Jokisch et al.
(Continued)

FOREIGN PATENT DOCUMENTS

EP 2942485 A1 11/2015
JP 2011122495 A 6/2011
(Continued)

OTHER PUBLICATIONS

PCT International Search Report and Written Opinion dated Apr. 3, 2018 corresponding to PCT Application PCT/US2018/013435 filed Jan. 12, 2018.

*Primary Examiner* — Moshe Wilensky

(57) ABSTRACT

A method is provided for machining an airfoil section (12) of a turbine blade or vane produced by a casting process. The airfoil section (12) has an outer wall (18) delimiting an airfoil interior having one or more internal cooling passages (28). The method involves: receiving design data pertaining to the airfoil section (12), including a nominal outer airfoil form ($\mathbf{40}_N$) and nominal wall thickness ($T_N$) data; generating a machining path by determining a target outer airfoil form ($\mathbf{40}_T$), the target outer airfoil form ($\mathbf{40}_T$) being generated by adapting the nominal outer airfoil form ($\mathbf{40}_N$) such that a nominal wall thickness ($T_N$) is maintained at all points on the outer wall around the one or more internal cooling passages (28) in a subsequently machined airfoil section; and machining an outer surface (18*a*) of the airfoil section (12) produced by the casting process according to the
(Continued)

generated machining path, to remove excess material to conform to the generated target outer airfoil form ($\mathbf{40}_T$).

10 Claims, 3 Drawing Sheets

(52) U.S. Cl.
CPC ..... *F05D 2230/18* (2013.01); *F05D 2230/21* (2013.01); *F05D 2240/304* (2013.01)

(56) References Cited

U.S. PATENT DOCUMENTS

| | | | | |
|---|---|---|---|---|
| 2014/0130999 | A1 | 5/2014 | Campbell et al. | |
| 2014/0257543 | A1* | 9/2014 | Rhodes ..... | G05B 19/4097 700/97 |
| 2014/0373503 | A1 | 12/2014 | Hanlon | |
| 2015/0369054 | A1 | 12/2015 | Propheter-Hinckley et al. | |

FOREIGN PATENT DOCUMENTS

| | | | |
|---|---|---|---|
| JP | 2013501884 | A | 1/2013 |
| JP | 2015536404 | A | 12/2015 |

* cited by examiner

View III-III

ADAPTIVE MACHINING OF COOLED TURBINE AIRFOIL

CROSS REFERENCE TO RELATED APPLICATIONS

This application claims priority to the U.S. provisional application No. 62/445,956 filed Jan. 13, 2017, which is incorporated by reference herein in its entirety.

BACKGROUND

1. Field

The present invention is directed generally to manufacturing turbine airfoils, and in particular to a process of adaptive machining of a cast turbine airfoil with internal cooling passages.

2. Description of the Related Art

Gas turbine airfoils are usually produced by means of casting, in particular, investment casting. A cooled turbine airfoil comprises one or more internal cooling passages that are formed using a core during the investment casting process. An investment casting process puts certain limitations on critical features of the airfoils, such as the outer wall thickness, trailing edge thickness and form, among others. For example, as schematically depicted in FIG. 1, during the casting process, the core may undergo deformation and/or displacement (shown by dashed lines), for example, due to differential solidification/shrinking of the metal parts. The example shown in FIG. 1 depicts core deformation in the form of twisting or rotation in case of a leading edge cooling passage LE and a trailing edge cooling passage TE, and a core displacement in case of a mid-chord cooling passage MC. The deformations of the core may lead to changes in form and/or position of the cooling passages, which may offset the wall thickness of the outer wall of the cast turbine airfoil from the nominal or target wall thickness of the same.

Casting limitations, such as that described above, correlate to a certain degree with the size and weight of the component. New generations of gas turbine engines tend to have increased sizes of the turbine airfoils to achieve a higher load. The needed airfoil geometry with thin airfoils may be challenging to produce by investment casting, due to such process limitations. So far, such casting limitations with a given airfoil size and form has limited the available design options.

SUMMARY

Briefly, aspects of the present invention provide a technique for adaptive machining of airfoils that may overcome certain casting process limitations, in particular, limitations involving core deformation and/or displacement.

According to a first aspect of the invention, a method is provided for machining an airfoil section of a turbine blade or vane produced by a casting process. The airfoil section has an outer wall delimiting an airfoil interior having one or more internal cooling passages. The method comprises receiving design data pertaining to the airfoil section, including a nominal outer airfoil form and nominal wall thickness data. The method further comprises generating a machining path by determining a target outer airfoil form. The target outer airfoil form is generated by adapting the nominal outer airfoil form such that a nominal wall thickness is maintained at all points on the outer wall around the one or more internal cooling passages in a subsequently machined airfoil section. The method then involves machining an outer surface of the airfoil section produced by the casting process according to the generated machining path, to remove excess material to conform to the generated target outer airfoil form.

According to a second aspect of the invention, a CAD module is provided for generating machining path data for adaptively machining an airfoil section of a turbine blade or vane produced by a casting process. The airfoil section comprises an outer wall delimiting an airfoil interior having one or more internal cooling passages. The CAD module is configured to receive design data pertaining to the airfoil section, including a nominal outer airfoil form and nominal wall thickness data. The CAD module is further configured to generate machining path data by determining a target outer airfoil form. The CAD module is configured to generate the target outer airfoil form by adapting the nominal outer airfoil form such that a nominal wall thickness is maintained at all points on the outer wall around the one or more internal cooling passages in a subsequently machined airfoil section. The machining path data defines information for machining an outer surface of the airfoil section produced by the casting process, to remove excess material to conform to the generated target outer airfoil form.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Embodiments of the present invention are illustrated in the context of a turbine blade, typically a large span blade usable in a low-pressure urbine stage of a gas turbine engine.

It should be noted that aspects of the present invention may be applicable to other turbine components having an airfoil section, such as rotating blades or stationary vanes at high or low pressure turbine stages.

Figure 1:
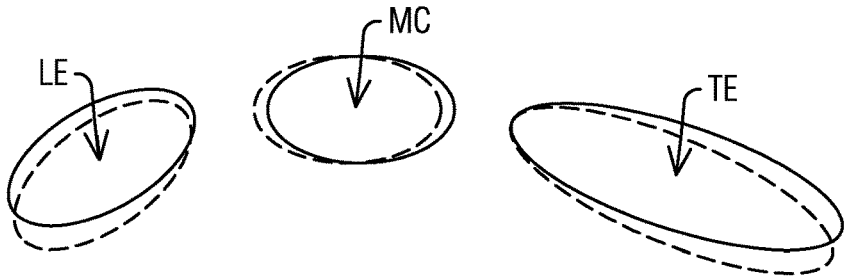
FIG. 1 is a schematic depiction of core deformation or displacement in an investment casting process for manufacturing a turbine airfoil.
Figure 2:
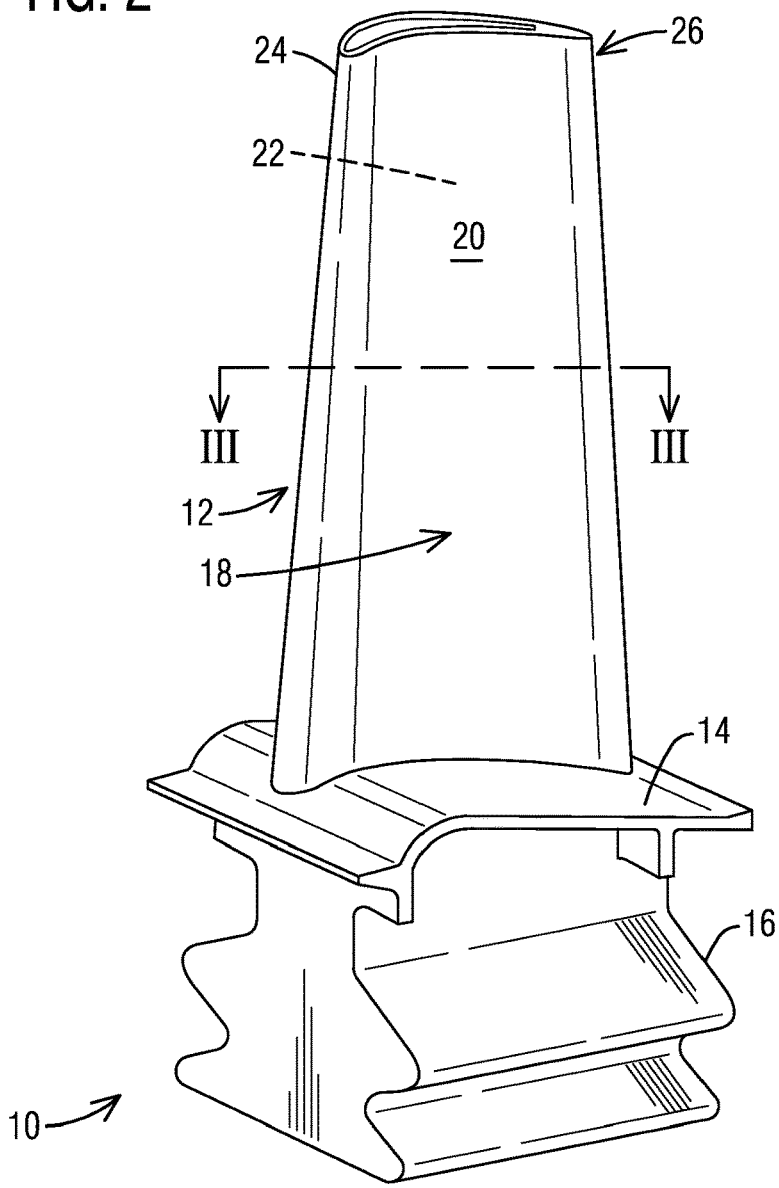
FIG. 2 is a perspective view of a cast turbine blade comprising an airfoil section wherein aspects of the present invention may be implemented.

Referring now to FIG. 2, a turbine blade 10 is illustrated, that may be produced by a casting process, for example, an investment casting process. The cast turbine blade 10 comprises an airfoil section 12 extending span-wise radially outward from a platform 14 in relation to a rotation axis (not shown). The blade 10 further comprises a root portion 16 extending radially inward from the platform 14, and being configured to attach the blade 10 to a rotor disk (not shown). Referring jointly to FIG. 1 and FIG. 2, the cast airfoil section 12 is formed of an outer wall 18 that delimits a generally hollow airfoil interior. The outer wall 18 includes a generally concave pressure side 20 and a generally convex suction side 22, which are joined at a leading edge 24 and at a trailing edge 26. The airfoil interior comprises one or more internal cooling passages 28 for radial flow of a cooling fluid. The internal cooling passages 28 may be defined between internal partition walls 30. The outer wall 18 comprises an outer surface 18*a* configured for facing a hot gas path and an inner surface 18*b* facing the internal cooling passages 28.

The internal cooling passages 28 are formed by a casting core during the investment casting process. As discussed above, during the casting process, the core may undergo deformation (e.g., rolling, rotation) and/or displacement, for example, due to differential solidification or shrinking of the metal parts. The deformations of the core may lead to changes in form and/or position of the internal cooling passages 28, which may offset the wall thickness of the outer wall 18 from its intended thickness. Aspects of the present invention address at least the above-described problems associated with core deformation and/or displacement.

In accordance with embodiments of the present invention, the final form of the airfoil section airfoil may be formed by adaptively post-machining the outside of the airfoil section (i.e., the outer surface 18*a* of the outer wall 18) beyond the casting limitation. As described herein referring to FIG. 3-6, a method for adaptive post-machining of a cast airfoil section comprises: receiving design data pertaining to the airfoil section 12, including a nominal outer airfoil form $\mathbf{40}_N$ and nominal wall thickness $T_N$ data; generating a machining path by determining a target outer airfoil form $\mathbf{40}_T$, the target outer airfoil form $\mathbf{40}_T$ being generated by adapting the nominal outer airfoil form $\mathbf{40}_N$ such that a nominal wall thickness $T_N$ is maintained at all points on the outer wall 18 around the one or more internal cooling passages 28 in a subsequently machined airfoil section; and machining an outer surface 18*a* of the airfoil section 12 produced by the casting process according to said machining path, to remove excess material to conform to the generated target outer airfoil form $\mathbf{40}_T$. The the target outer airfoil form $\mathbf{40}_T$ is adapted to account for core shift (deformation and/or displacement) during the casting process, and is generated based on the prioritized consideration of the following criteria in the stated order: 1) the nominal wall thickness of the outer wall 18 around the internal cooling passages 28, and 2) the nominal airfoil outer form.

In a first pre-machining step, subsequent to the casting process, a three-dimensional (3-D) measurement is carried out to determine an outer form of the individual cast airfoil section. The 3-D measurement may be carried out, for example, by tactile coordinate measuring machine probing, or laser scanning or photogrammetry, any combinations thereof, or by another other measurement technique to obtain 3-D geometrical data pertaining to the outer form of the cast airfoil section. The measured outer form, which is indicated by the 3-D surface $\mathbf{40}_A$ in FIG. 4, corresponds to the outer surface 18*a* of the cast airfoil section 12 shown in FIG. 3.

Figure 3:
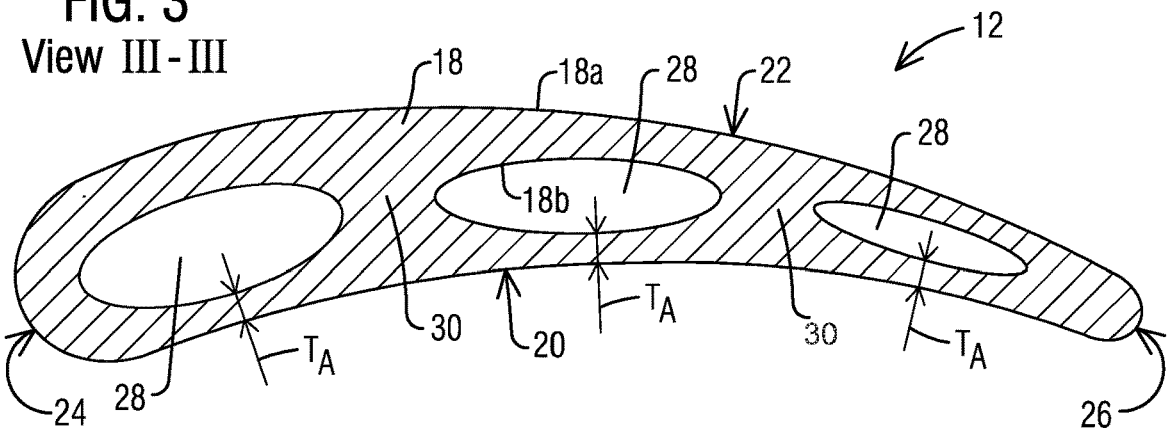
FIG. 3 is a cross-sectional view along the section in FIG. 2.

A next step involves obtaining cooling passage position and form measurements for the internal cooling passages 28 in relation to the measured outer form $\mathbf{40}_A$ of the cast airfoil section 12. The cooling passage position and form measurements may be carried out by obtaining actual wall thickness measurements (indicated as TA) at a plurality of points along the outer wall 18 of the cast airfoil section 12, as shown in FIG. 3. It should be noted that the measured actual wall thickness, although indicated uniformly as TA for the sake of simplicity, may vary for different points on the outer wall 12. The wall thickness measurements may be performed using ultrasound or x-ray or computed tomography or eddy current, or any other known technique. For example, in case of measurement using ultrasound, the wall thickness TA may be measured by placing a signal transmitter/probe at a point on the outer surface 18*a* of the outer wall 18 of the airfoil section 12 and determining a distance to a point on the inner surface 18*b* of the outer wall 18 from which the strongest echo signal is received. By measuring the wall thickness values at a sufficiently large number of points along the axial (chord-wise) and radial extent of the outer wall 18, a 3-D geometry 28*m* of the cooling passages (including form and position) may be determined in relation to the measured outer form $\mathbf{40}_A$ of the cast airfoil section, as shown in FIG. 4.

Figure 4:
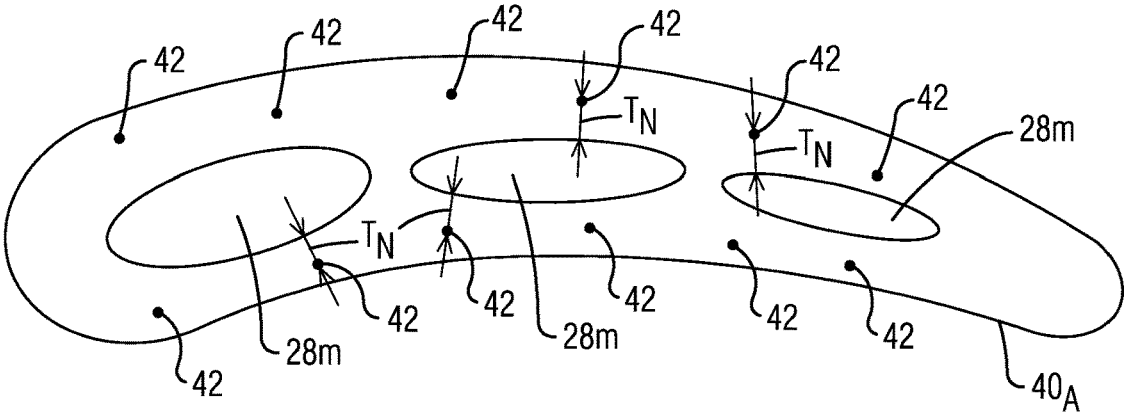
FIG. 4 is a schematic diagram illustrating construction of points representing nominal wall thickness values around measured positions of internal cooling passages in the airfoil section.

Still referring to FIG. 4, in a subsequent step, points 42 are constructed around the measured positions of the internal cooling passages 28*m*, which represent nominal wall thickness ($T_N$) values obtained from design data. That is, the points 42 are constructed at a distance equal to the nominal or design wall thickness $T_N$ from respective points on the periphery of the measured form 28*m* of the internal cooling passages. The points 42 may be constructed along the radial span of the cooling passages. For the sake of simplicity, the nominal thicknesses are uniformly indicated as $T_N$. One skilled in the art would recognize that the nominal thickness values may vary for different points around the internal cooling passages, both in radial and axial (chord-wise) directions.

Figure 5:
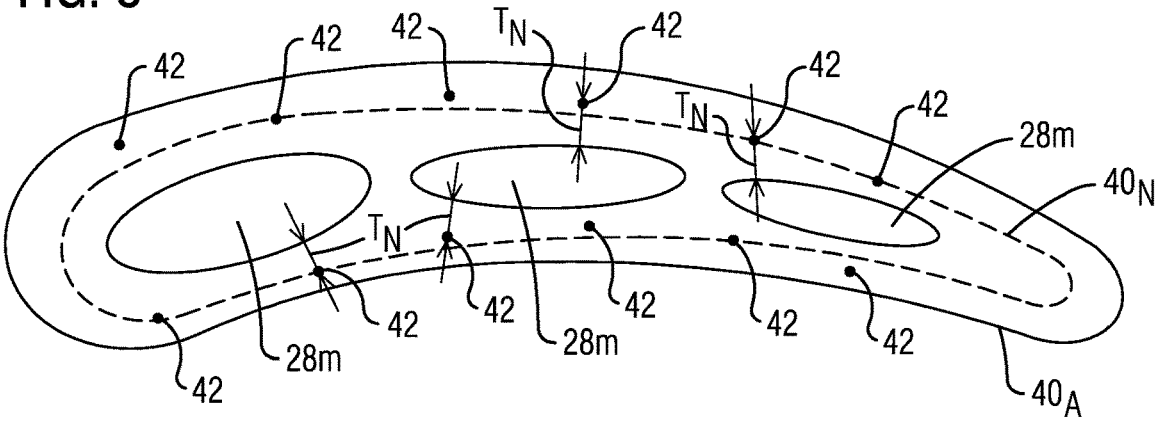
FIG. 5 is a schematic diagram illustrating a best fit alignment of a nominal outer airfoil form to said points representing nominal wall thickness values.

Next, as shown in FIG. 5, an iterative best fit operation is performed to align a 3-D nominal outer airfoil form $\mathbf{40}_N$ (obtained from design data) to the points 42 representing nominal wall thickness $T_N$ values. In case of an ideal casting process, all points 42 representing nominal wall thickness values would lie on the nominal outer airfoil form $\mathbf{40}_N$. In the illustrated example, due to changes in angular orientation as well as relative displacement of the casting core during the casting process, at least some of the points 42 deviate from the nominal outer airfoil form $\mathbf{40}_N$ after the best fit alignment.

Figure 6:
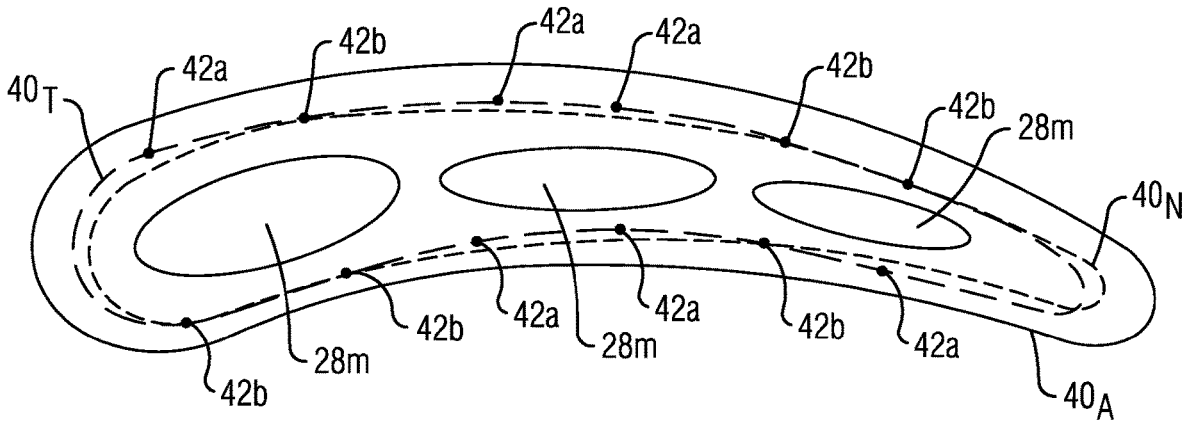
FIG. 6 is a schematic diagram illustrating a target outer airfoil form, which conforms to a final outer surface of the airfoil section after machining.

Next, as shown in FIG. 6, a target outer airfoil form $\mathbf{40}_T$ is generated by adapting the nominal outer airfoil form $\mathbf{40}_N$ subsequent to the best fit alignment. As shown in FIG. 6, the points representing nominal wall thickness values that deviate from the nominal outer airfoil form $\mathbf{40}_N$ (i.e., points that lie either inside or outside the nominal outer airfoil form $\mathbf{40}_N$) after the best fit alignment are indicated as 42*a*, while those points representing nominal thickness values that lie on the nominal outer airfoil form $\mathbf{40}_N$ (or within a defined tolerance) after the best fit alignment are depicted as 42*b*. The target outer airfoil form $\mathbf{40}_T$ is a 3-D form that is generated by adjusting the 3-D nominal outer airfoil form $40_N$, so that the points 42*a* that deviated from the best fit alignment of the nominal outer airfoil form $40_N$, now lie on the target outer airfoil form $40_T$. The target outer airfoil form $40_T$ therefore conforms to all points 42*a* and 42*b* representing nominal wall thickness values, as depicted in FIG. 6. As noted above, the target outer airfoil form $40_T$ is determined based on a prioritized criteria for adaptation, namely nominal wall thickness ($T_N$) and nominal outer airfoil form ($40_N$) obtained from design data.

The above described steps for generation of the target outer airfoil form $40_T$ may be implemented via a computer aided design (CAD) as described below. In the illustrated embodiment, the CAD module may be adapted for constraining the target outer airfoil form $40_T$ such that the target outer airfoil form $40_T$ does not extend beyond the measured outer form $40_A$ of the cast airfoil section 12.

Based on the target outer airfoil form $40_T$, machining path data may be generated. The machining path data defines information for machining an outer surface of the cast airfoil section, corresponding to the measured form $40_A$, to remove excess material to conform to the generated target outer airfoil form $40_T$. Based on the generated machining data, the outer surface of the outer wall may be machined, for example, by grinding or milling. However, the outer wall machining may be carried out by other means, including, without limitation, electro-chemical machining (ECM) and electrical discharge machining (EDM), among others.

For post-machining of turbine blades or vanes of a given turbine row, the machining of each individual airfoil section may be adapted to fit the form of the outer airfoil surface and the internal cooling passages simultaneously. Thereby, for machining each individual airfoil section of the row of blades or vanes, a specific machining path is generated. Since the core deformations vary between individual airfoils, the machining path generation and machining execution may be adapted specific to each individual turbine airfoil.

Figure 7:
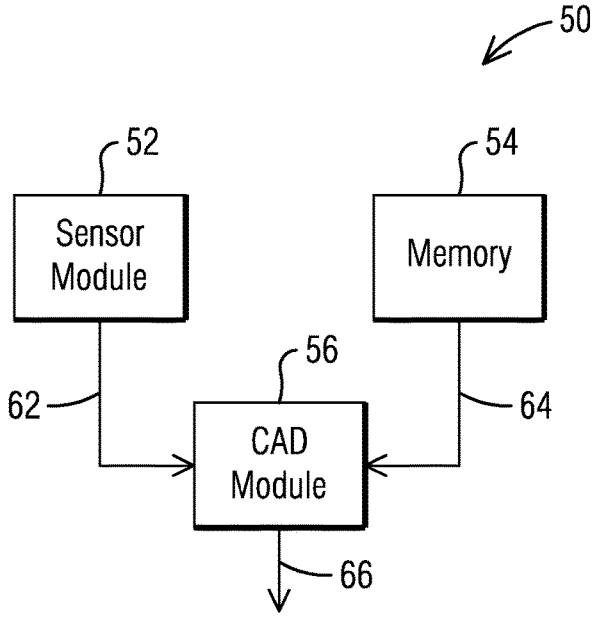
FIG. 7 is a schematic diagram illustrating a system for adaptively machining a cast airfoil section according to an aspect of the present invention.

A further aspect of the present invention is directed to an automated system for adaptive post-machining of a cast airfoil section. As shown in FIG. 7, such a system 50 may comprise a sensor module 52 comprising sensors for performing 3-D measurements of the outer form of the cast airfoil section and for measuring cooling passage form and position by measurement of actual wall thickness values of the cast airfoil section, as described above. The system 50 may also comprise memory means 54 containing design data, for example, in the form of a 3-D model or a CAD model of the turbine blade or vane. The system 50 further comprises a CAD module configured to receive measurement data 62 from the sensor module 52, and design data 64 (e.g., nominal wall thickness values, nominal outer airfoil form) from the memory 54, to generate machining path data 66 according to the above-described method. The CAD module may be a sub-component for a computer aided design package. The machining path data 66 generated by the CAD module may comprise a numeric control (NC) program. The system 50 further comprises a machining device for machining an outer surface of the cast turbine airfoil based on the machining data 66. The CAD module may automatically set-up, check and adapt NC programs for each individual cast turbine airfoil. It will be appreciated that the CAD module may be defined in computer code and used to operate a computer to perform the above-describe method. Thus the method and articles embodying computer code suited for use to operate a computer to perform the method are independently identifiable aspects of a single inventive concept.

The above described embodiments involving adaptive machining of thin airfoils may overcome casting process limitations, thus making it possible to produce un-castable geometries, for e.g. allow production of thinner airfoils, airfoils with no or low taper, thinner trailing edges. Thinner airfoil outer walls may significantly reduce centrifugal pull loads in rotating turbine blades, particularly in low pressure turbine stages. The illustrated embodiments also allow a more cost-effective production method compared to reducing wall thickness by casting process optimization. A further benefit is the possibility to relief casting process tolerances and/or increase casting wall thickness, thus increasing casting yield and therefore reducing casting cost.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A method for machining an airfoil section of a turbine blade or vane produced by a casting process, the airfoil section comprising an outer wall delimiting an airfoil interior having one or more internal cooling passages, the method comprising:

receiving design data pertaining to the airfoil section, including a nominal outer airfoil form and nominal wall thickness data;

generating a machining path by determining a target outer airfoil form, the target outer airfoil form being generated by adapting the nominal outer airfoil form such that a nominal wall thickness is maintained at all points on the outer wall around the one or more internal cooling passages in a subsequently machined airfoil section; and machining an outer surface of the airfoil section produced by the casting process according to said machining path, to remove excess material to conform to the generated target outer airfoil form, wherein determining the target outer airfoil form comprises:

measuring a three-dimensional outer form of the airfoil section after the casting process;

obtaining cooling passage position and form measurements for the one or more internal cooling passages in relation to the measured outer form of the cast airfoil section, the cooling passage position and form measurements being carried out by obtaining actual wall thickness measurements at a plurality of points along the outer wall of the cast airfoil section;

constructing points representing nominal wall thickness values around the measured position of the one or more internal cooling passages;

performing a best fit operation to align the nominal outer airfoil form to said points representing nominal wall thickness values; and generating the target outer airfoil form by adapting the nominal outer airfoil form after the best fit alignment to pass through each of the points representing nominal wall thickness values.

2. The method according to claim 1, further comprising constraining the target outer airfoil form such that the target outer airfoil form does not extend beyond the measured outer form of the cast airfoil section.

3. The method according to claim 1, wherein the measurement of a three-dimensional outer form of the airfoil section is performed by tactile coordinate measuring machine probing, or laser scanning or photogrammetry, or combinations thereof.

4. The method according to claim 1, wherein the actual wall thickness measurements are performed using ultrasound or x-ray or computed tomography or eddy current, or combinations thereof.

5. The method according to claim 4, wherein the actual wall thickness measurements are performed at various points along the span-wise and chord-wise directions of the cast airfoil section.

6. The method according to claim 1, wherein the machining path comprises a numerical control (NC) program.

7. The method according to claim 1, wherein the machining the outer surface of the airfoil section is carried out by a machining process selected from the group consisting of: grinding, milling, electro-chemical machining (ECM) and electrical discharge machining (EDM).

8. A method for manufacturing a row of turbine blades or vanes, comprising:

producing a plurality turbine blades or vanes by a casting process, each blade or vane comprising an airfoil section with one or more internal cooling passages;

machining an outer surface of each airfoil section subsequent to said casting process by a method according to claim 1, wherein the machining paths used for said machining are generated specific to the airfoil section of each individual blade or vane.

9. A CAD module for generating machining path data for adaptively machining an airfoil section of a turbine blade or vane produced by a casting process, the airfoil section comprising an outer wall delimiting an airfoil interior having one or more internal cooling passages, wherein:

the CAD module is configured to receive design data pertaining to the airfoil section, including a nominal outer airfoil form and nominal wall thickness data;

the CAD module is configured to generate machining path data by determining a target outer airfoil form, wherein the CAD module is configured to generate the target outer airfoil form by adapting the nominal outer airfoil form such that a nominal wall thickness is maintained at all points on the outer wall around the one or more internal cooling passages in a subsequently machined airfoil section;

the CAD module is configured to receive three-dimensional outer form measurement data pertaining to the cast airfoil section;

the CAD module is configured to obtain cooling passage position and form measurements for the one or more internal cooling passages in relation to the measured outer form of the cast airfoil section, the cooling passage position and form measurements being carried out by obtaining actual wall thickness measurements at a plurality of points along the outer wall of the cast airfoil section;

the CAD module is adapted to construct points representing nominal wall thickness values around the measured position of the one or more internal cooling passages;

the CAD module is adapted to perform a best fit operation to align the nominal outer airfoil form to said points representing nominal wall thickness values; and the CAD module is adapted to generate the target outer airfoil form by adapting the nominal outer airfoil form subsequent to the best fit alignment, to pass through each of the points representing nominal wall thickness values, wherein the machining path data defines information for machining an outer surface of the airfoil section produced by the casting process, to remove excess material to conform to the generated target outer airfoil form.

10. The CAD module according to claim 9, further wherein:

the CAD module is configured to constrain the target outer airfoil form such that the target outer airfoil form does not extend beyond the measured outer form of the cast airfoil section.

* * * * *